United States Patent [19]

Fasth

[11] 4,239,157

[45] Dec. 16, 1980

[54] HIGH PRESSURE SPRAY GUN

[75] Inventor: Anders G. Fasth, Skara, Sweden

[73] Assignee: Atlas Copco Aktiebolag, Nacka, Sweden

[21] Appl. No.: 23,588

[22] Filed: Mar. 26, 1979

[30] Foreign Application Priority Data

Apr. 11, 1978 [SE] Sweden ..... 7804033

[51] Int. Cl.[3] ..... B05B 1/04

[52] U.S. Cl. ..... 239/288.5; 239/599

[58] Field of Search ..... 239/288.5, 599, 288, 239/596, 526, 600, 601

[56] References Cited

U.S. PATENT DOCUMENTS

| | | | |
|---|---|---|---|
| 3,556,411 | 1/1971 | Nord et al. | 239/581 |
| 3,952,955 | 4/1976 | Clements | 239/288.5 |
| 3,963,180 | 6/1976 | Wagner | 239/288.5 |
| 4,025,045 | 5/1977 | Kubiak | 239/599 X |
| 4,036,438 | 7/1977 | Soderlind et al. | 239/288.5 |

FOREIGN PATENT DOCUMENTS

| | | | |
|---|---|---|---|
| 1960510 | 6/1970 | Fed. Rep. of Germany | 193/37 X |
| 2011806 | 3/1978 | United Kingdom | 193/37 X |

*Primary Examiner*—Robert B. Reeves
*Assistant Examiner*—Gene A. Church
*Attorney, Agent, or Firm*—Frishauf, Holtz, Goodman & Woodward

[57] ABSTRACT

A high pressure spray gun for airless atomization of spray material comprising a safety head mounted on the spray nozzle. The safety head is formed with two parallel protector studs comprising two opposed ridges located transversely to the spray direction and forming a transverse gap through which the spray material has to pass. The ridges are each defined by one flat forwardly inclined surface on each stud and by a common cylindrical surface which forms a transverse part-cylindrical chamber in the safety head. The ridges are formed with opposed edges and prevent spray material from setting on the projector studs.

4 Claims, 2 Drawing Figures

HIGH PRESSURE SPRAY GUN

BACKGROUND OF THE INVENTION

This invention relates to an airless high pressure spray gun.

In particular, the present invention relates to a high pressure spray gun of the type having safety means for avoiding accidental physical contact between parts of the human body and the unatomized part of the spray jet adjacent the spray nozzle opening.

The unatomized part of a spray jet discharged at high pressure is very dangerous because of its ability to penetrate human skin and flesh and, therby, cause severe injury to, for instance, the user of the spray gun. By providing the spray gun with safety means in the form of forwardly extending protector studs, accidental contact with the unatomized part of the spray jet is avoided.

A spray nozzle provided with such protector studs is shown in U.S. Pat. No. 3,556,411. However, the safety means of the disclosed spray nozzle is disadvantageous in that the protector studs thereof easily get covered with spray material and that the operation of the gun thereby is impaired.

The object of the present invention is to create a safe high pressure spray gun provided with protector studs which are prevented from being hit by the spray material.

SUMMARY OF THE INVENTION

In accordance with the present invention, an airless high pressure spray gun comprises a gun body; a spray material valve disposed in the gun body; a spray forming nozzle having a geometric axis; and a safety head coupled to the nozzle and including two protector studs extending in the spraying direction from the nozzle. The protector studs extend respectively on each side of the geometric axis of the nozzle, each of the protector studs comprising a transverse ridge which is spaced transversely from the geometric axis and which is axially spaced from the nozzle in the spraying direction, the ridges being disposed out of reach of the spray jet formed by the nozzle and the ridges each being arranged in an opposed relationship to an identical ridge of the other of the protector studs. The protector studs, between the ridges and the spray forming nozzle, together form an open ended part-cylindrical chamber, the geometric axis of which is substantially perpendicular to the geometric axis of the spray forming nozzle, the part-cylindrical chamber extending to the vicinity of the spray opening of the nozzle.

DETAILED DESCRIPTION

Figure 1:
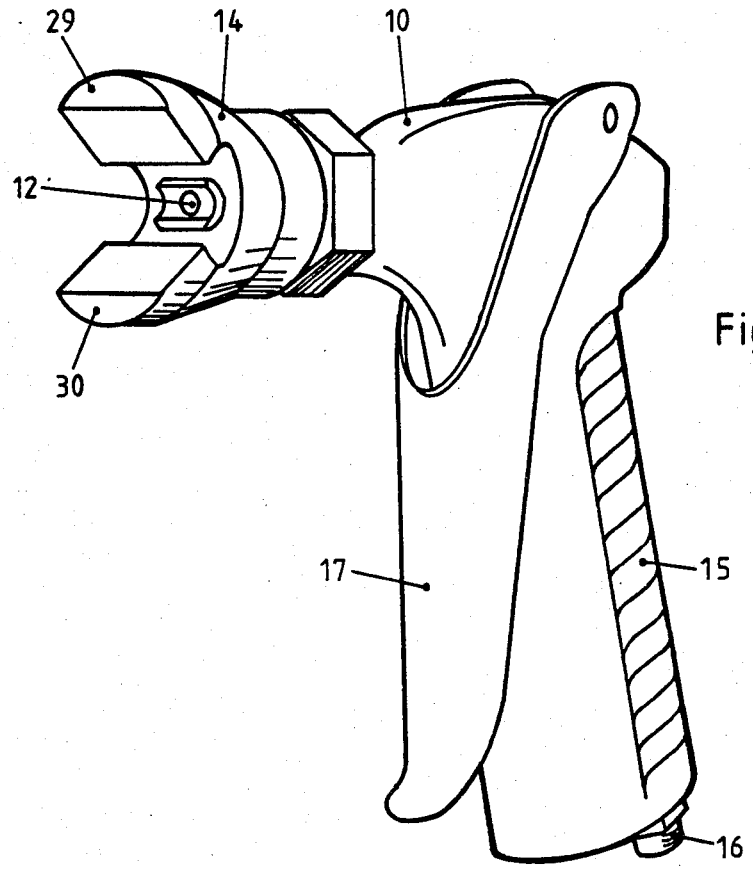
FIG. 1 shows a perspective view of an airless high pressure spray gun provided with a safety means according to the invention.

The spray gun shown on the drawing comprises a gun body 10 supporting a spray material valve 11, a spray forming nozzle 12 including a discharge opening 13 and a safety head 14. The spray gun further comprises a handle 15, a nipple 16 for connecting the spray gun to a spray material pressure source and a trigger lever 17 for operating the spray material valve 11.

The spray material valve 11 comprises a seat 18 rigidly mounted in a valve socket 19 and a movable valve body 20. The latter is connected to a maneuver rod 21 by means of a coupling sleeve 22. The maneuver rod 21 is coupled to the trigger lever 17 via a non-disclosed mechanism.

At the forward end of the valve socket 19, there is mounted one or more transverse deflector pins 24 the object of which is to prevent a solid high energy jet from being ejected from the gun when the spray nozzle 12 is removed. Preferably, the deflector pins 24 are two in number and disposed in a parallel relationship to each other.

The nozzle 12 is clamped against the forward end of the valve socket 19, by means of a retaining sleeve 25. The latter is threaded onto the forward end of the gun body 10 and has a hexagonal rear portion 26 to be engaged by a spanner.

The forward part 27 of the retaining sleeve 25 is cylindrical and arranged to receive thereon the safety head 14. The latter comprises a rear cylindrical socket portion 28 to be fitted onto the forward part 27 of the retaining sleeve 25. The safety head 14 further comprises two protector studs 29, 30 extending in the spray direction on opposite sides of the geometric axis 31 of the discharge opening 13 of the nozzle 12. The protector studs 29,30 are intended to prevent the operator or any other person present during spraying from getting into physical contact with the ejected spray material too close to the discharge opening 13, i.e. before spray material has become atomized.

The forward part 27 of the retaining sleeve 25 is provided with an annular, wedge shaped shoulder 32 which together with an annular groove 33 in the safety head 14 forms a snap coupling for retaining the latter on the spray gun.

Axially spaced from the spray nozzle 12, the protector studs 29,30 are formed with transverse, inwardly directed ridges 34,35. The ridges 34, 35 are defined by inclined surfaces meeting in edges 36, 37 at the top of the ridges. The inclined surfaces are constituted on one hand by an inner cylindrical surface 38, the axis of which extends transversely through the safety head 14, and on the other hand by two forwardly facing, flat surfaces 39,40 one on each stud. The cylindrical surface 38 defines a transverse, part cylindrical chamber 41.

The safety head according to the invention is very advantageous from the aerodynamic point of view, because the air flow generated by the ejected spray material is led through the safety head in such a way as to keep the spray material out of contact with the protector studs.

Figure 2:
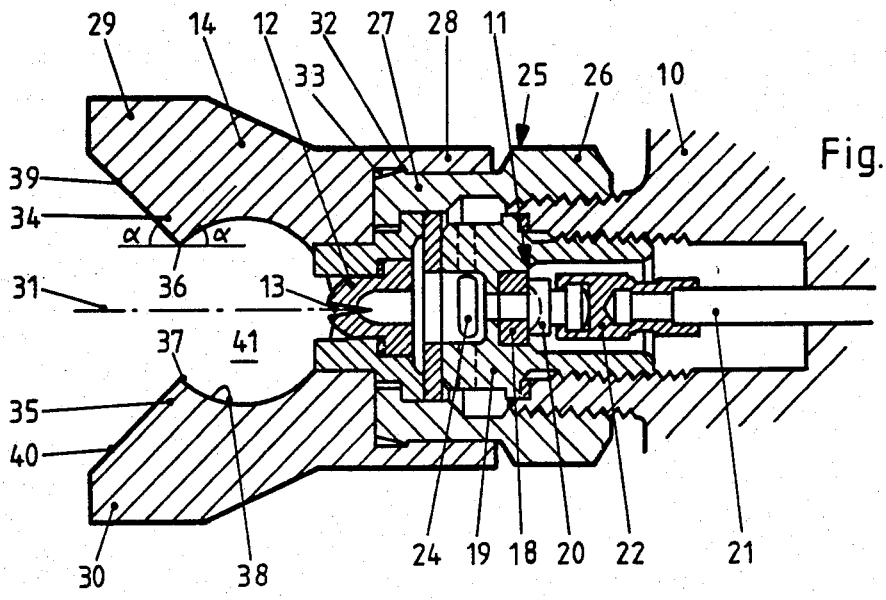
FIG. 2 shows a longitudinal section through the front part of the spray gun in FIG. 1.

In the shown embodiment of the invention, the inclined surfaces of the ridges 34, 35 have equal angles of inclination in the vicinity of the edges 36,37. These angles are illustrated by the letter $\alpha$ in FIG. 2.

Between the opposite edges 36, 37, there is formed a transverse gap through which the ejected spray material has to pass when leaving the gun.

I claim:

1. In an airless high pressure spray gun, comprising:

a gun body (10);

a spray material valve (11) disposed in the gun body;

a spray forming nozzle (12) having a geometric axis (31); and a safety head (14) coupled to said nozzle (12) and including two protector studs (29, 30)

extending in the spraying direction from the nozzle (12), said protector studs extending respectively on each side of the geometric axis (31) of the nozzle (12), each of said protector studs comprising a transverse ridge (34) which is spaced transversely from said geometric axis (31) and which is axially spaced from the nozzle (12) in the spraying direction, said ridge being disposed out of reach of the spray jet formed by the nozzle and said ridge being arranged in an opposed relationship to an identical ridge (35) of the other of said protector studs to form a gap between the ridges (34,35);

said protector studs (29, 30), between said ridges (34, 35) and the spray forming nozzle (12), together forming an open ended part-cylindrical chamber (41) the geometric axis of which is substantially perpendicular to the geometric axis (31) of the spray forming nozzle (12), said part-cylindrical chamber (41) extending to the vicinity of the spray opening of said nozzle (12) and said part-cylindrical chamber (41) having a diameter which exceeds the width of said gap between said opposed ridges (34, 35).

2. Spray gun according to claim 1, wherein each of said ridges (34, 35) is defined by two inclined surfaces (38, 39) meeting at an edge (36) at the top of the ridge (34), one of said inclined surfaces (38) being a cylindrical surface portion of said part-cylindrical chamber (41).

3. Spray gun according to claim 2, wherein said two inclined surfaces (38, 39) adjacent said edge (36) are inclined relative to the geometric axis (31) of the spray forming nozzle (12) by equal angles ($\alpha$).

4. Spray gun according to any one of claims 2 or 3, wherein said oppositely disposed ridges (34, 35) define a transverse gap through which the spray emitted from the spray forming nozzle (12) has to pass.

* * * * *

UNITED STATES PATENT AND TRADEMARK OFFICE

CERTIFICATE OF CORRECTION

PATENT NO. : 4,239,157

DATED : December 16, 1980

INVENTOR(S) : Anders G. FASTH

It is certified that error appears in the above—identified patent and that said Letters Patent is hereby corrected as shown below:

COLUMN 4, line 15, change "claims 2 or 3" to --claims 1, 2 or 3--.

Signed and Sealed this

*Fourteenth* Day of *April 1981*

[SEAL]

*Attest:*

RENE D. TEGTMEYER

*Attesting Officer*

*Acting Commissioner of Patents and Trademarks*